US006164340A

United States Patent [19]

Krumm

[11] Patent Number: 6,164,340

[45] Date of Patent: Dec. 26, 2000

[54] METHOD AND APPARATUS FOR TEMPORARILY ACTIVATING A BRAKE IN A WEAVING LOOM

[75] Inventor: Valentin Krumm, Hergensweiler, Germany

[73] Assignee: Lindauer Dornier Gesellschaft mbH, Germany

[21] Appl. No.: 09/544,844

[22] Filed: Apr. 6, 2000

[30] Foreign Application Priority Data

Apr. 6, 1999 [DE] Germany ..... 199 15 349

[51] Int. Cl.[7] ..... D03D 5/06

[52] U.S. Cl. ..... 139/1 E; 139/116.1; 139/116.2

[58] Field of Search ..... 139/1 E, 370.2, 139/116.1, 194

[56] References Cited

U.S. PATENT DOCUMENTS

| | | | |
|---|---|---|---|
| 4,215,728 | 8/1980 | Weidman | 139/370.2 |
| 4,450,876 | 5/1984 | Van Mullekom | 139/450 |
| 4,586,543 | 5/1986 | Volland et al. | 139/452 |
| 4,617,971 | 10/1986 | Hellstroem | 139/370.2 |
| 4,848,417 | 7/1989 | Martinus et al. | 139/452 |

FOREIGN PATENT DOCUMENTS 0195469 12/1993 European Pat. Off. .

OTHER PUBLICATIONS

Weiterentwickelte Steuerungselektronik fuer Webmaschinen, Melliand Textile Reports, Nov. 1990, pp. 859, 860 Untranslated.

*Primary Examiner*—Andy Falik
*Attorney, Agent, or Firm*—W. F. Fasse; W. G. Fasse

[57] ABSTRACT

The brake components of a clutch brake combination in an automatic high speed loom are periodically cleaned to avoid delays in the brake action that occur following a prolonged loom operation without a stopping. The stopping signal is either derived from randomly occurring events or criteria such as a weft breakage or similar criteria on the one hand, or when a criterium stored in the memory or program of the loom control occurs. The respective control signal is generated in response to whichever criterium occurs first.

10 Claims, 1 Drawing Sheet

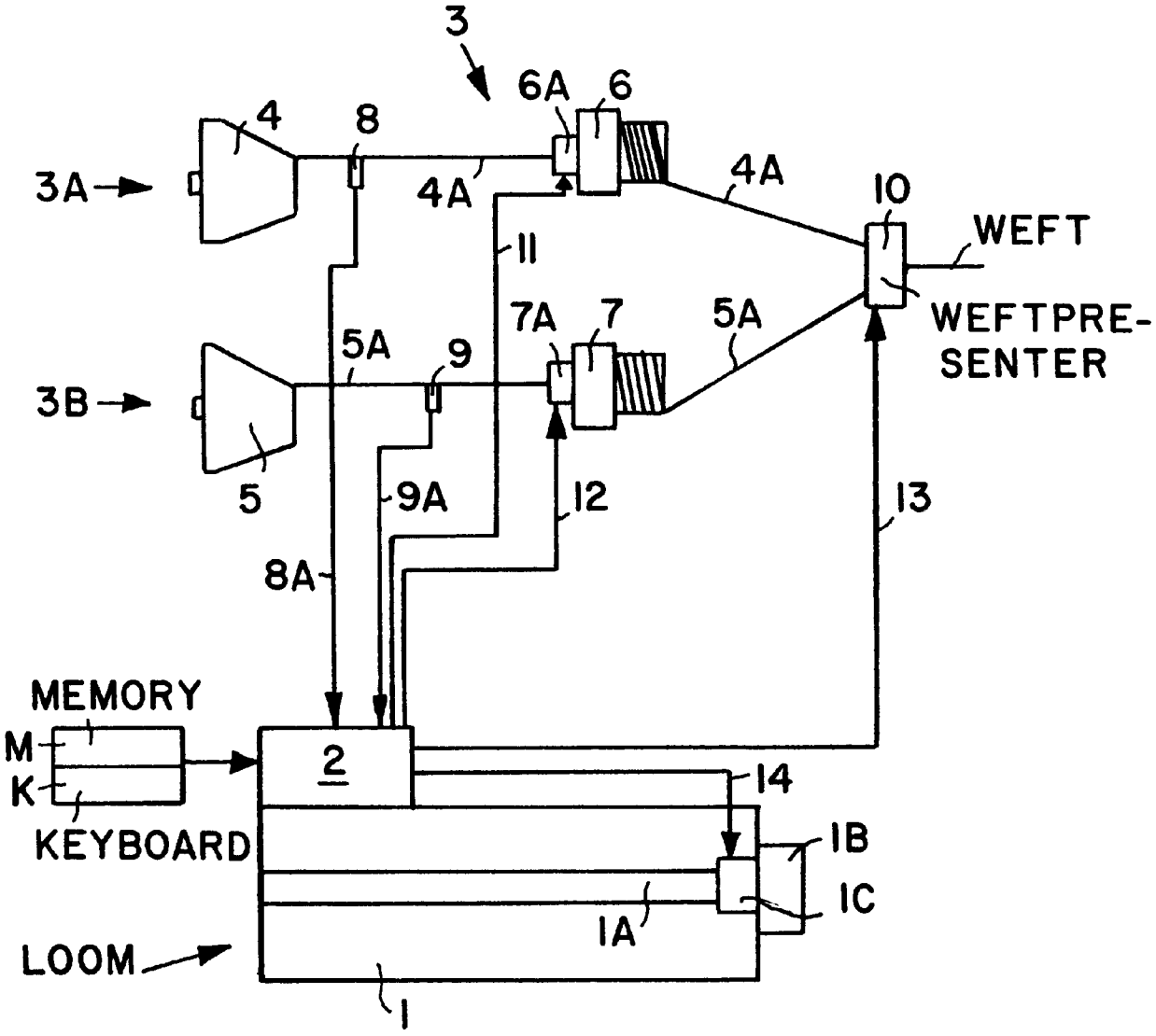
WEFT
WEFTPRE-SENTER
10
13
4A
5A
6
7
6A
7A
12
11
3
4A
9
9A
8
5A
2
8A
4
5
3A
3B
MEMORY
M
K
KEYBOARD
LOOM
14
1B
1C
1A
1

METHOD AND APPARATUS FOR TEMPORARILY ACTIVATING A BRAKE IN A WEAVING LOOM

PRIORITY CLAIM

This application is based on and claims the priority under 35 U.S.C. §119 of German Patent Application 199 15 349.3, filed on Apr. 6, 1999, the entire disclosure of which is incorporated herein by reference.

FIELD OF THE INVENTION

The invention relates to a method and apparatus for temporarily activating a brake in a weaving loom to keep the brake clean thereby assuring a rapid braking action when a loom is to be stopped by avoiding brake conditions that can cause delays in the effectiveness of the brake response characteristic.

BACKGROUND INFORMATION

Conventionally, efforts have been made to continue the weaving operation of a loom as long as possible by avoiding interruption of the weaving process. However, prolonged weaving operations have their disadvantages as will be explained below. In order to enable an uninterrupted weaving operation for hours on end, certain conditions must be met. A first condition is that the supply of weft yarns and warp yarns is substantially continuous. Another condition requires that the weft and warp yarns are resistant to breakage to be able to withstand the mechanical strain or wear and tear during the weaving operation of looms, particularly high speed mechanical looms.

It is known from "Melliand Textile Reports", 1990, Vol. 11, pages 859 to 860, to monitor the weaving process on looms in an all encompassing manner in order to assure that the proportion of faulty fabrics is held as small as possible. The just mentioned monitoring involves, among others, the arrangement of at least one thread monitor or weft stop motion device upstream of the weft feeders, that is between the weft feeders and the thread supply spools. Such a sensor or weft stop motion device provides an electrical signal in response to a broken weft thread, or when a weft thread is missing altogether, or when the weft has a fault. The electrical signal is used for stopping the loom prior to the respective weft feeder running empty, for example when the fault is a break in the weft thread upstream of the weft feeder.

European Patent Publication EP 0,195,469 B2 discloses a system that is based on the use of a weft stop motion device in a position described above, however with the improvement of avoiding stopping the loom by using a weft thread supply system with at least a first and a second weft supply spool, each cooperating with a weft feeder operated in a so-called weft mixing weaving operation. The known system works in such a way that upon detection of a weft thread break within one or more weft supply passages between the respective yarn supply spool and the respective weft feeder, the corresponding weft feeder is switched off and another weft feeder receives a signal for rotating faster to double its weft thread supply capacity thereby avoiding stopping the loom. In this manner it is possible to continue the weaving without interruption in spite of the disablement of one of the roving bodies by increasing the weft supply capacity of another roving body in the supply system.

Furthermore, it is known to measure the length of a pattern repetition in a weaving operation and to compare the actually measured pattern length with rated tolerance values stored in a memory. The comparing takes place at the completion of each pattern to see whether the just completed length of fabric is within the rated or given limits. If the just completed pattern length is outside the permissible limits, a signal is generated to stop the loom and to indicate the deviation in a display.

Other efforts in the past have also improved the mechanical capabilities of looms to enable high speed looms to operate continuously for hours on end without interrupting the weaving operation.

While a continuous weaving operation without interruption is efficient in certain respects, it has its disadvantages because when the time comes that the loom must be stopped, fabric faults cannot be avoided, particularly in looms equipped with a clutch brake combination between the loom drive motor and the main loom drive shaft. This drawback is due to the fact that the clutch brake combination is subject to a certain time delay between the stop signal and the actual stopping of the loom drive shaft and such delay becomes longer in duration the longer the loom was operating without interruption.

Observations in practice have shown that a weaving operation continuing for several hours on high speed looms without interruption of the weaving operation have the disadvantage that the environmental conditions caused by such continuous weaving adversely influence the braking characteristic of the loom brake, specifically the braking operation of the clutch brake combination. This adverse influence causes the above delay between the stop signal and the actual stopping of the loom drive shaft due to the high relative humidity in the weaving hall and the high fly lint which in combination form a sliding film on the brake components of the clutch brake combination. This sliding film causes in response to a brake activating signal a type of aqua planing which delays the loom stopping until this film is rubbed off. This delay in the braking action following the stop signal causes misaligned positions of the main loom drive shaft compared to positions that the main loom drive shaft should assume in accordance with programmed brake and stop positions. Thus, the delay in the braking action leads, for example to the fact that the sley and thus the reed mounted on the sley perform a beat-up along the beat-up line which in turn leads to densification of the fabric. As a result, when the loom is started again, so-called start markings become visible in the fabric which diminishes the fabric quality.

OBJECTS OF THE INVENTION

In view of the above it is the aim of the invention to achieve the following objects singly or in combination:

- to avoid so-called start markings or starting faults in a fabric by avoiding delays in the braking action applied to the loom main drive;
- to time the loom stopping at sufficiently short time intervals to assure that the deposit of a braking action diminishing film on the brake components of the loom brake are avoided;
- to make sure that following a weft break in one weft supply path, the speed up of the weft supply through another supply path takes place only during stoppage of the main loom drive shaft; and
- to clean the brake components in a loom at random and/or periodic intervals by briefly or temporarily activating the brake just long enough to remove braking action impairing deposits on the brake components.

SUMMARY OF THE INVENTION

According to the invention electrical signals that represent random or periodic different criteria are used to activate the loom brake to temporarily stop the main loom drive shaft. Such brake activation removes a lint film from the brake components, thereby preventing delays in the braking action. Two types of criteria are used for the brake cleaning action. One type of criteria involves indefinite criteria that cannot be calculated and occur at random, such as a weft thread break, or a fault in a weft thread, or the absence of a weft thread sensed by weft stop motion sensors positioned between weft supply spools and weft feeders. The other type involves definite criteria that are known, such as the count of a determined number of inserted weft threads, a measured time duration of uninterrupted weaving, or the weaving of a certain length of fabric has been woven. The brake is activated by one or the other type of signal whichever comes first.

It is an important advantage of the invention that the brake action is tested, so to speak, at intervals which are short enough to prevent an accumulation of lint film on the brake components to an extent that would be harmful for the brake characteristic. Thus, the invention assures a rapid brake action with a precise stopping of the main loom drive shaft in the proper angular position thereby avoiding start faults.

BRIEF DESCRIPTION OF THE DRAWINGS

In order that the invention may be clearly understood, it will now be described by way of example, with reference to the single Figure of the accompanying drawing showing a loom and its weft supply system and its control according to the invention.

DETAILED DESCRIPTION OF PREFERRED EXAMPLE EMBODIMENTS AND OF THE BEST MODE OF THE INVENTION

A loom 1 comprises a main loom drive shaft 1A driven by a main loom drive motor 1B through a clutch brake combination 1C. The loom also comprises a central loom control 2 including a memory M and an input such as a keyboard K. The memory M stores loom control programs and the input K permits the entry of further programs or program changes.

The loom 1 is equipped with a weft supply system 3 comprising at least two weft supply paths 3A, 3B. The path 3A comprises a weft supply spool 4 feeding a weft thread 4A to a feeder 6 which in turn supplies the weft thread 4A to a weft presenter or weft inserter 10 which may, for example, be a weft insertion nozzle or the like.

The weft supply path 3B also comprises a supply spool 5 feeding a weft thread 5A to a feeder 7 which in turn feeds the thread 5A to the weft presenter or inserter 10.

A first weft monitor 8 monitors the supply of the weft thread 4A and is positioned between the spool 4 and the feeder 6. The sensor is a so-called weft stop motion device 8 connected through an electrical conductor 8A to the central loom control 2. Similarly, the supply of the weft thread 5A is monitored by a weft stop motion device 9 connected through an electrical conductor 9A to the central loom control 2. An electrical control conductor 11 connects an output of the control 2 to a drive 6A of the feeder 6. Similarly, a control signal is supplied from an output of the central loom control 2 through an electrical control conductor 12 to the drive 7A of the feeder 7.

According to the invention, the central loom control programming is such, that control signals for accelerating one or the other feeder drive 6A, 7A are generated only in response to an activation of the brake portion of the clutch brake combination 1C which takes place in response to a randomly occurring control signal provided by the central loom control 2 through an electrical control conductor 14, when a weft fault is detected. The weft presenter 10 is also stopped in its operation by a signal from the control 2 through a control conductor 13 in response to the stopping of the main loom drive shaft 1A. However, when activating the brake takes place in response to a periodic, determined control signal then the feeder drives are merely briefly stopped and accelerated again to their normal supply speed.

The above mentioned two types of criteria for the generation of electrical control signals to periodically interrupt the weaving operation include among the indefinite criteria the breakage or other defect of a weft thread or its absence, which are referred to herein as weft faults. These weft faults are monitored by the two weft stop motion devices 8 and 9 positioned between the respective supply spools 4, 5 and the feeders 6, 7. These sensors 8 and 9 also monitor when a supply spool runs empty. According to the invention the respective electric signals are not used for an immediate automatic switch over for increasing the speed of one supply path 3A or 3B without stopping the loom as taught in European Patent Publication EP 0,195,469 B2. Rather, according to the invention the main loom drive shaft is first stopped by activating the clutch brake combination 1C which receives a signal through the conductor 14 from the main loom control 2 to stop the main loom drive shaft 1A and only during a short stop period will the switch over of the still fully functional weft supply path 3A or 3B to a higher speed be performed through either the control conductor 11 or the control conductor 12. According to the invention, only between the stopping of the weaving operation and the renewed starting will the signal for doubling the weft supply speed of one or the other of the supply path 3A or 3B be applied in the example embodiment of two weft supplies 3A, 3B. More such supply paths may be used.

The invention achieves the advantage that a signal that signifies a weft fault first briefly activates the clutch brake combination 1C, thereby cleaning the brake elements to avoid delays caused by the above mentioned sliding film that accumulates over time when the brake elements are not activated. This feature has the further advantage that the main loom drive shaft will always stop in a programmed angular position rather than in a random position which may cause a beat-up when none is intended. Once the braking operation is complete and the operational supply path has been switched to a higher speed, the main loom drive shaft is automatically in the angular position which the drive shaft had just prior to the beginning of the braking operation.

According to the invention, an automatic switch over of the weft supply paths operating in a weft mixing fashion during the weaving operation can be avoided altogether because the switch over to a higher speed of one of the weft supply paths can take place advantageously in the short time duration between the stopping of the loom and the renewed starting of the loom. This short time duration is about 30 seconds.

Other definite criteria for a periodical stopping of the loom for the purpose of cleaning the brake components are stored in the memory of the central loom control 2. Such definite criteria include, for example the count of a predetermined number of weft insertions or the passage of a definite time duration of uninterrupted weaving. A counter and a timing circuit arrangement in the central loom control generate the respective control signals that are supplied to the clutch brake combination 1C through the control conductor 14. The number of inserted wefts can, for example be counted by monitoring the weft presenter. The time durations between loom start and the intended stopping can be programmed through the keyboard, for example. Assuming, for example that a proper cleaning of the brake components requires an activation of the clutch brake combination 1C every thirty minutes in a continuous loom weaving operation either by a random signal or by a periodic signal. Assuming further that no random signal has been generated during these thirty minutes. In such a situation the periodic signal will automatically activate the loom brake. However, if a weft supply fault has been detected within the last thirty minutes, the timing for the next brief stoppage will be reset. Thus, the present system makes sure that the clutch brake combination 1C will be activated at least once every time interval suitable for the intended brake cleaning such as thirty minutes either by the random occurrence of a weft supply fault or by the preset timing or counting signal whichever occurs first.

The resetting of the definite criteria to zero, such as resetting a weft counter or timer with the stopping of the main drive shaft in response to one of the indefinite criteria, is followed automatically by a restarting of the counter or timer in response to the restarting of the loom drive so that again it is assured that a loom stoppage is performed, either in response to either one of the indefinite criteria or in response to the definite criteria, whichever comes first.

The invention avoids the drawbacks of the prior art which aim at prolonged continuous loom operations, thereby ignoring the disadvantages of brake contamination. The invention avoids these disadvantages by periodically cleaning the brake components so that sliding actions of the brake components that prevent a rapid brake operation are avoided. As a result, the fabric produced according to the invention is free of so-called starting faults caused by a delayed brake action in conventional looms.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for cleaning components of a brake in a loom, said method comprising the following steps:

(a) generating a first electrical signal in response to an occurrence of any one of a first plurality of random criteria;

(b) generating a second electrical signal in response to an occurrence of any one of a second plurality of controlled periodic criteria;

(c) feeding said first and second electrical signals to a central loom control for producing respective first and second brake stop control signals; and (d) temporarily activating said brake in response to that first or second brake stop control signal whichever occurs first to assure said cleaning before dirt accumulation on said brake components can cause delays in a brake response to any one of said first and second brake stop control signals.

2. The method of claim 1, wherein said random criteria comprise any one of weft breaks, weft faults, and missing weft threads.

3. The method of claim 1, wherein said second criteria are based on counting a number of weft insertions and generating said second brake stop control signal in response to reaching a predetermined count of said weft insertions.

4. The method of claim 3, further comprising restarting said counting of said weft insertions in response to said first or second brake stop control signal following a temporary activating of said brake.

5. The method of claim 1, wherein said controlled criteria comprise counting time and generating said second brake stop control signal in response to the passage of a predetermined length of time.

6. The method of claim 5, further comprising restarting said time count in response to said first or second brake stop control signal following a temporary activating of said brake.

7. The method of claim 1, further comprising performing said generating of said first electrical signals by sensors positioned between weft supply spools and floating or roving weft supply feeders.

8. A loom comprising a main loom drive, main drive shaft, a clutch connecting said main drive shaft to said main loom drive, a brake for stopping said main loom drive shaft, a main loom control, a plurality of weft supply spools, and weft feeders (6, 7) including feeder drives for feeding weft threads to said loom, a weft stop motion device including a sensor positioned between each weft supply spool and a respective feeder (6, 7) for producing first randomly occurring loom stop signals in response to any weft fault, said main loom control comprising a memory having stored therein a program for periodically generating second loom stop signals, and conductor means connecting said main loom control to said sensors, to said feeder drives and to said brake for temporarily activating said brake and stopping said main drive shaft in response to said randomly occurring loom stop signals or in response to said periodically occurring loom stop signals whichever occurs first, and for accelerating any one of said feeder drives in response to said first random loom stop signals.

9. A method for randomly activating a brake in a loom, comprising the following steps:

(a) monitoring a weft supply between a weft supply spool and a weft feeder for providing a weft fault signal in response to the random occurrence of a weft fault;

(b) generating a random brake control signal in response to said weft fault signal; and (c) activating at least temporarily said brake in response to said random brake control signal.

10. The method of claim 9, further comprising monitoring the generating of said random brake control signal whether said generating occurs within a certain time interval, and generating a certain brake control signal if the random brake control signal does not occur within said certain time interval.

* * * * *